United States Patent [19]

Camilleri

[11] Patent Number: 4,753,405

[45] Date of Patent: Jun. 28, 1988

[54] SUPPORT BRACE ASSEMBLY FOR SHELF

[75] Inventor: Charles F. Camilleri, St. Louis, Mo.

[73] Assignee: Lee-Rowan Company, St. Louis, Mo.

[21] Appl. No.: 787,540

[22] Filed: Oct. 2, 1985

[51] Int. Cl.[4] ..... E04G 3/08

[52] U.S. Cl. ..... 248/235; 248/73; 211/90; 108/152; 108/134; 411/45; 411/55; 411/60

[58] Field of Search ..... 248/235, 73, 74.3, 74.2; 211/90; 108/152, 134, 135; 411/45, 55, 57, 60, 40, 41

[56] References Cited

U.S. PATENT DOCUMENTS

| | | | |
|---|---|---|---|
| 2,504,343 | 4/1950 | Mitchell | 108/134 X |
| 2,639,817 | 5/1953 | Ehret | 211/90 X |
| 3,383,786 | 5/1968 | McIntosh | 402/80 P |
| 3,419,155 | 12/1968 | Black et al. | 108/134 X |
| 3,954,243 | 5/1976 | Sharp et al. | 248/235 |
| 4,263,833 | 4/1981 | Loudin et al. | 411/41 |
| 4,361,099 | 11/1982 | Kokenge et al. | 108/134 X |

FOREIGN PATENT DOCUMENTS

| | | | |
|---|---|---|---|
| 629805 | 12/1961 | Italy | 411/60 |
| 865101 | 4/1961 | United Kingdom | 211/90 |

*Primary Examiner*—Ramon S. Britts
*Assistant Examiner*—Blair M. Johnson
*Attorney, Agent, or Firm*—Rogers, Howell, Moore & Haferkamp

[57] ABSTRACT

A support brace assembly for shelves such as shoe shelves has an integrated unitary structure comprising a truss with a lower leg having a support rib and a foot which rests stably against a wall. This leg is joined as by a gusset and a strut to an upper leg which has reinforcing ribs, with a front hook integral with the truss and for receiving a shelf rod so that the rod may be received within the hook bite with the bite gripping the rod. A rear resilient hook is integral with the upper leg and has a bite to receive another shelf rod flush against the bite. The upper leg has a foot which rests against the wall. The rear hook is spaced from the foot so that the passage between the tip of the rear hook and the foot is less than the thickness of the shelf rod received by the hook so that when the rod is moved through the passage, the rear hook expands to allow entry of the rod and snaps back to hold the rod in position. The foot of the upper leg has a wall anchor integral therewith. The anchor has fingers laterally expandable when a drive pin is driven through the anchor. The fingers have transverse wall portions engageable by the drive pin to swing the fingers to substantially 90° angles to the axis of the drive pin and anchor. A web is in the path of the pin as it approaches the fingers. A stop is hinged to the upper foot by an integral short plastic strap and is pivotable to block the open side of the rear hook to further prevent removal of the inserted rod from that hook and to hide the head of the drive pin.

9 Claims, 2 Drawing Sheets

SUPPORT BRACE ASSEMBLY FOR SHELF

BACKGROUND AND SUMMARY OF THE INVENTION

This invention pertains to a support brace assembly for mounting a shelf to a wall and particularly to such an assembly using a strong, integral support brace having converging legs for supporting the shelf in a downwardly inclined position so that it can serve as a shoe rack. Various types of devices have been used to support such shelves. In the past such devices have involved a number of separate components and therefore are not unitary and economical in structure. The prior art devices do not maximize the load supporting capacity of the structural members. Heretofore in some devices, a wall anchor has been used to mount the device, and the wall anchor has been of the kind having laterally expandable fingers that are expanded against the back side of a wall when a screw is extended through the wall anchor.

In summary, there are many shelf supporting braces in the prior art, and some have been mounted with wall anchors having laterally expandable fingers. However, none are designed to support a shelf at a downwardly inclined position wherein the brace comprises a strong integral combination of converging legs, structural webs and gussets, an integral wall anchor having fingers that are laterally expandable in the presence of a drive pin, and an integral hinged stop that both locks the shelf to the brace and hides the head of the pin.

Thus, in spite of the myriad of pins and braces for supporting shelves to walls, including a wide variety of devices for attaching the braces to the walls, none incorporate the combination of features of the present invention.

The support brace assembly of the present invention is particularly adapted to be used with shelves of the kind having transverse support rods. The support brace assembly comprises a brace having a unitary molded truss with a lower leg having a wall end that can bear against a wall to provide stable support. Yet the wall end need not be physically attached to the wall. An upper leg also has a wall end incorporating a special anchor for attachment of the brace to the wall. From their wall ends, the upper and lower legs converge toward their free or front ends where they are integrally connected together.

Additional integral connections between the upper and lower legs can include a strut and a gusset, and the legs preferably have integral supporting ribs between the strut and gusset for added strength. Preferably the lower leg, which is in compression when in use, has a cross section of greater area than the upper leg which is in tension when in use. A pair of support hooks are integrally formed at the wall end and free end of the upper leg with the hook at the free or front end preferably being disposed at the apex of the truss defined by the junction of both legs. This front hook has a curvature which permits a shelf rod to be received within the hook.

The other hook is disposed toward the wall end the upper leg and because of a special hinged stop, this hook can have a bite which encircles less than a 180° arc.

The stop is integrally joined to the upper leg by a thin plastic strip that acts as a hinge. A latch projection extends from the stop and a recess in the upper leg receives the latch projection to lock the stop to the foot when the stop has been pivoted about the plastic strip hinge to a closed position. When the stop is in the closed position it blocks the hook opening to prevent release of a transverse shelf rod from the hook. In addition, in the latched position, the stop hides the head of a drive pin, as will be apparent.

A wall anchor extends from the upper leg to extend through a pre-drilled hole in a wall. The anchor has a body section with rings on its outer surface. The rings on the body section are sawtooth in side view and the forward-facing edges of the rings are substantially radial to the body so that they resist removal of the wall anchor from the hole in the wall to a maximum degree.

Laterally expandable fingers are joined to the rear of the body section by unitary plastic connectors that act as hinges. The fingers are normally together, as molded. Therefore, it is not necessary to squeeze the fingers together to insert the body section into a predrilled hole in a wall. The laterally expandable fingers include transverse wall portions in the path of a passage through the body section so that when a drive pin is driven through the body section, its lead end will contact the wall portions and, through a camming action, spread the fingers into laterally extending positions, and hold them there. The transverse walls are preferably inclined inwardly and toward the head of the socket so that the pin will pivot the fingers as far outwardly as possible toward ninety degree projections relative to the axis of the passage.

A special feature of this invention is the provision of a web slightly spaced from the transverse walls. There is a small opening through the web, such as a slit. Without the web, a stress line would be formed during molding, the end of the core forming the passage where that core intersects the transverse walls. By providing the web, the location of the stress line is moved to the intersection of the core and the web, and the walls joining the web and the transverse walls can be formed rounded with no stress lines. This avoids failure at the pivot lines of the fingers that might result from stress lines.

The web performs another function. As the drive pin is driven through the passage, it first contacts the web and, because the slit is parallel to the pivot lines of the fingers, the pin will split the web and pivot its halves toward the fingers. Thereafter, when the pin cams the fingers outwardly, the web halves lie against the pin and present edges opposing a tendency of the transverse walls to slide back along the pin.

The drive pin can be held in a ready position in the body section by projections which press against the pin sufficiently to hold it in the body section. From this ready position, the pin can be driven by a hammer.

The aforementioned recess in the pivotally mounted stop is such that when the drive pin is forced through the anchor body section to the hilt, the head of the pin is comfortably housed within the stop recess when the stop is in the latched position so that the pin is concealed.

The stop is molded in an upright position and will normally hold that position until manually pivoted about its hinge. This leaves maximum exposure of the pin head area to a hammer. Even after driving the drive pin to anchor the support brace to a wall, the stop is left in the upright position until installation of the shelf.

After at least two of the support braces have been mounted to a wall, the shelf is installed by first moving one of the shelf transverse rods to the entrance to the rear hook while moving another transverse rod to a position in alignment with the opening to the front hook. The two transverse rods can then be moved forwardly so that the rear transverse rod presses against the tip of the rear hook to press the resilient hook to widen the hook opening to permit passage of the transverse rod therethrough. The rear hook can then spring downwardly to press against the rear transverse rod to hold it in place. As the rear rod moves forwardly, the front transverse rod moves into the opening of the front hook to rest within the bite of that hook in a stable and rigid mounting position. After installing of the shelf, the stops can be latched in place, locking the shelf rod in the hooks.

The invention thus provides a single unitary brace which can be made of molded plastic, which is simple and inexpensive in design. Even the one separate part of the brace assembly, the drive pin, is preloaded and held in the wall anchor, ready to be driven, and provides stable support with but one portion of the brace being affixed to the wall while another portion of the brace provides stable support by simply resting against the wall in a detached position. The design utilizes the material forming the structure in a solid rigid fashion to provide stability, and provides for ease in manufacturing, packaging, and shipping.

Because the support brace is unitary there are no problems as customary with braces having multiple parts, such as dropping, losing or misplacing parts, especially smaller parts, and having to take the time to correctly follow various directions to attach individual parts together. The pin of the brace assembly is attached to the brace so that the installer needs no externally supplied nails, screws or other parts to do the installation.

DESCRIPTION OF PREFERRED EMBODIMENT

Figure 1:
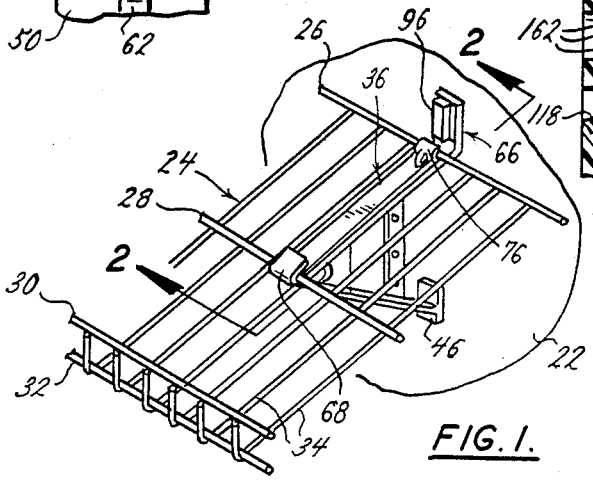
FIG. 1 is an orthogonal projection of the support brace assembly shown mounting a shelf to a wall.
Figure 13:
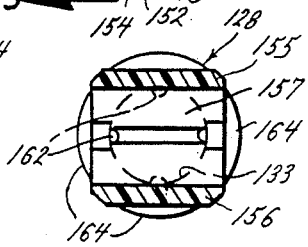
FIG. 13 is a section taken on the line 13—13 of FIG. 12.

The drawings show a support brace assembly 18 which comprises a unitary support brace 20 of plastic and a separate pin to be described. As depicted in FIG. 1, the brace 20 is mounted to a wall 22 to support a shelf 24 in an orientation that is particularly useful for supporting objects such as shoes. The shelf 24 is of a type well known in the art and comprises a plurality of transverse support rods 26, 28, 30, and 32 which are welded to thinner longitudinal L-shaped rods 34.

Figures 2, 3, 4, 5, 6, 7, 14:
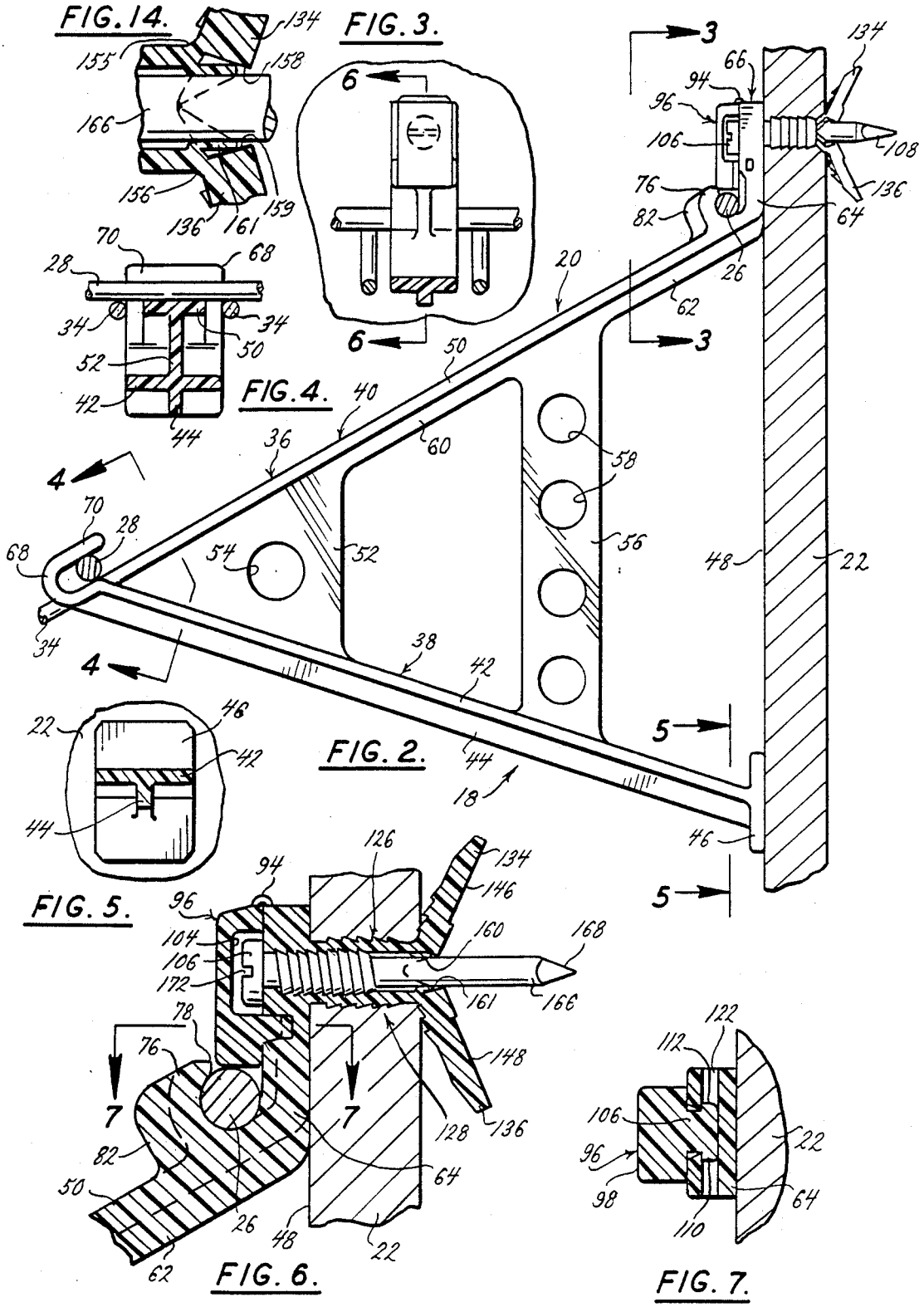
FIG. 2 is a section taken on the line 2—2 of FIG. 1.
FIG. 3 is a section taken on the line 3—3 of FIG. 2.
FIG. 4 is a section taken on the line 4—4 of FIG. 2.
FIG. 5 is a section taken on the line 5—5 of FIG. 2.
FIG. 6 is a section taken on the line 6—6 of FIG. 3.
FIG. 7 is a section taken on the line 7—7 of FIG. 6.
FIG. 14 is an enlarged view in medial section of the central portion of the socket showing the web with the pin driven through it.

As shown more clearly in FIG. 2, the support brace 20 comprises a truss 36 which has a lower leg 38 that integrally joins an upper leg 40 at the front of truss 36. As FIG. 2 shows, the upper and lower legs 36 and 38 converge toward their juncture. The lower leg 38 comprises a beam 42 with an integral downwardly projecting rib 44 both of which terminate rearwardly into a foot 46 having a flat rear surface resting flush against the front flat surface 48 of the wall 22.

The truss upper leg 40 comprises a beam 50. A vertical gusset 52, having a circular hole 54, is integrally connected to the interior sides of the beams 42 and 50. A vertical strut 56 having holes 58 is integrally connected to the interior sides of the beams 42 and 50 and is spaced from the gusset 52 to further structurally join the beams 42 and 50. The truss 36 structure with the gusset 52 and strut 56 is the preferable structure, although the space between the legs 38 and 40 could be interconnected with a solid span of integral material.

The beam 50 has an integral interior rib 60 extending between the gusset 52 and the strut 56, and an integral interior rib 62 extending from the strut 56 to the interior end of an upper foot 64 which is integral with the rear end of the beam 50. The upper foot 64 forms part of a wall anchor assembly 66. The rear flat surface of the foot 64 rests flush against the front face 48 of the wall 22.

The cross sectional area of the lower leg 38 is greater than that of the upper leg 40 which better accommodates the operating conditions of the lower leg 38 being in compression and the upper leg 40 being in tension.

At the apex of the truss 36 is a resilient hook 68 which is integral with the end of the upper beam 40 and the lower beam 42 and rib 44. As seen in FIG. 2, the hook tip 70 extends parallel to the beam 40 to create an elongated hook of substantial tolerance, so that when the shelf rod 28 fits within the hook 68, the rod 28 will be held by the elongated tip 70 from moving out of the hook bite.

On the top side at the rear of the beam 50, a second integral hook 76 projects upwardly. The front of the hook 76 preferably has an integral rib 82 projecting forwardly therefrom and extending integrally into the top of the beam 50.

Figure 9:
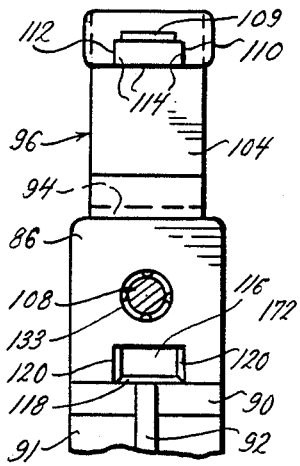
FIG. 9 is a section taken on the line 9—9 of FIG. 8.
Figure 8:
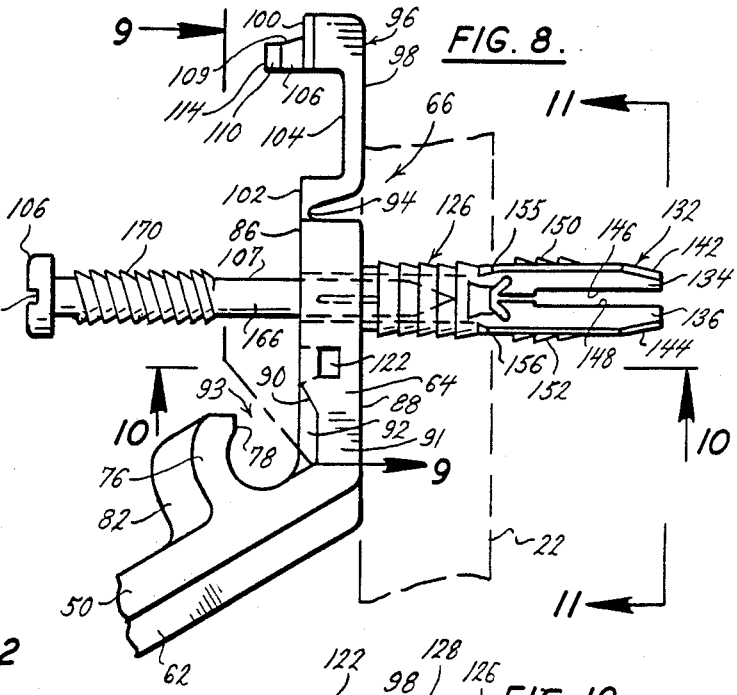
FIG. 8 is a side elevation of the rear upper part of the support brace assembly with the drive pin shown in the normal ready position in the anchor socket and with the stop in the open upright position, and with no transverse rod shown mounted within the rear hook.

The upper foot 64 has a front face 86 and a rear face 88, as seen more clearly in FIG. 8. Below its center, the front face 86 has a span 90 that is inclined downwardly and rearwardly, terminating in a short vertical wall 91 which is integral with the rear of the beam 50. A rib 92 projects forwardly from the span 90 and the wall 91 (FIGS. 8 and 9). The distance between the tip 78 of the hook 76 and the adjacent rib 92 define an opening or passage 93. The width of the mouth of the passage 93 is less than the diameter of the rod 26 so that the shelf rod 26 will snap into the bite of the hook 76 and be restrained from being released. When the rod 26 is fully inserted, it rests flush against the bite of the hook 76. When the stop 96 is pivoted to the closed position of FIG. 6, the passageway 93 is blocked to prevent movement of the rod 26 therethrough.

A short thin plastic hinge 94 projects integrally from the toe of the foot 64 to be integrally connected to a stop 96. The stop 96 has an outer surface 98 and opposite thereto, coplanar inner surfaces 100 and 102 that are spaced from one another by a recessed section 104. The recessed section 104 is slightly larger than the head 106 of a metal drive pin 108 which also forms part of the support assembly 18 and the anchor assembly 66.

It is noted that the thin hinge 94 normally holds the stop 96 in the upright position shown in FIG. 8. However, the hinge 94 is bendable to allow the stop 96 to be pivoted to the closed position shown in FIGS. 2 and 6. It is also observed that the hinge 94 is set back slightly from the faces 86 and 102 which allows these faces to make contact in the locked position of FIG. 6 without bending the hinge 94 too sharply.

Extending from the stop face 100 is a projection 106 having a tapered wall 109 and having laterally extending lock flanges 110 and 112 (FIGS. 7 and 9). Preferably the leading edges 114 of the projection 108 are rounded.

In the front face 86 of the upper foot 64 there is a recess 116, with a lower inclined wall 118, complementary to the projection 106 and its inclined face 109. The recess 116 also has tapered side walls 120 that make entrance to the recess 116 easier (see FIG. 9). To accommodate the lateral flanges 110 and 112, a transverse recess 122 intercepts the recess 116. For ease of molding, as known in the art, the recess 122 extends between and opens through the sides of the foot 64. The span between the ends of the flanges 110 and 112 is greater than the narrowest width of the recess 116, so the flanges 110 and 112 will snap into the transverse recess 122.

Integrally molded to and extending from the rear surface of the foot 64 is a wall anchor 126, which has a socket 128 that receives the drive pin 108.

The socket 128 includes a body section 130 and a finger section 132. There is a passage 133 through the body section 130 communicating with the finger section 132. The finger section 132 includes two fingers 134 and 136 having flat outer surfaces 138 and 140, respectively, terminating in tapered nose sections 142 and 144 at the lead end of the socket 128. Inwardly, the fingers 134 and 136 have opposed flat surfaces 146 and 148. Toward their trailing ends, the fingers 134 and 136 have barbs 150 and 152, respectively, that are sawtooth in side elevation as shown in FIG. 8.

Figure 12:
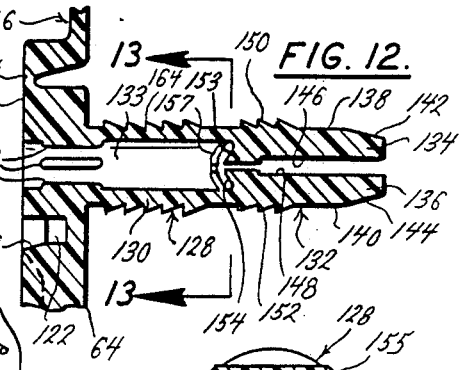
FIG. 12 is a section taken on the line 12—12 of FIG. 11.

The fingers 134 and 136 are formed with forwardly and inwardly inclined transverse walls 153 and 154 (FIG. 12) that extend across the passage 133 through the body section 130. Preferably, these walls 153 and 154 are at angles of about 60 degrees to the axis of the passage 133 to maximize the lateral extent of movement upon contact with the drive pin 108, as will be described. (This inclination per se is not new). Immediately adjacent the walls 153 and 154, there are short hinge sections 155 and 156 molded as integral parts of the plastic socket 128 of generally the same thickness as that of the wall of the socket body section 130. Spaced from the walls 153 and 154, a web 157 is formed integral with the socket 128. A slit across the width of the web parallel to the faces 146 and 148 has opposed edges 158 and 159. The slit separates the web into halves 160 and 161 which, as shown in FIG. 12, are generally parallel to the walls 153 and 154. Although the intersection of the passage 133 and the web 157 may have a stress line, the short sections 155 and 156 can be unstressed and even rounded, as shown in FIG. 12.

Referring to the body section 130, a plurality of longitudinally extending ribs 162 project inwardly on the inner wall of the passage 133. The primary purpose of these ribs 162 is to grip the shank of the drive pin 108 to hold the pin 108 in a ready condition. In other words, the circumscribed internal diameter defined by the ribs 162 is slightly less than the diameter of the shank of drive pin 108.

On the outer surface of the body section 130 are a plurality of rings 164 that are generally sawtooth in side elevation. The outer diameters of the rings 164 are essentially the same as the span between the barbs 150 and 152 so that both the fingers 134 and 136 and the body section 130 of the socket 128 will fit in the same size hole in wall 22.

In its preferred form, the drive pin 108 has a shank 166 with a point 168 on its lead end. Other shapes of the lead end are possible. Generally, the lead section of the shank 166 is cylindrical like a nail, whereas the trailing section is formed with a double helix thread 170. The double helix thread 170 is sawtooth in side elevation so that the drive pin 108 can be driven, as by a hammer, into the wall 20 and can be rotated to withdraw it. For both of these purposes, the nail head 106 has a screwdriver kerf 172 (or Phillips head groove) in it. The diameter of the cylindrical shank 166 is about equal to the internal diameter of the passage 133, whereas the outer diameter of the helical threads 170 is greater than the diameter of the passage 133. Therefore, when the drive pin 108 is started into the passage 133 and pressed within the longitudinal ribs 162, the ribs 162 will grip the pin 108 and hold it in place. Because the socket 128 is plastic, it will yield, and the pin 108 can be inserted manually.

It is thus seen that the entire brace 20 can be a unitary structure made inexpensively of molded plastic.

Operation and Use

The support brace 20 is first mounted to the wall 22. To do this, the drive pin 108 is pressed into the passage 133 until the leading portion of the shank 166 is pressed within the area of the ribs 162. (Normally the support brace is sold with this done, so the pin is already in the ready position for the user). These ribs 162 will hold the drive pin 108 in place. The wall 22 should have a hole drilled in it of a diameter slightly greater than the diameter of the socket body 130, and less than the diameter of the rings 164. The socket 128 can then be pushed into the hole in the wall 22, and the rings 164 will hold it in place temporarily. Now, a hammer can drive the head 106 of the drive pin 108. As the drive pin 108 extends into the socket 128, it presses against the web 157, deflecting the web sections 160 and 161 toward the walls 153 and 154. Thereafter, the pin 108 engages the transverse walls 153 and 154 of the fingers 134 and 136 and pivots the fingers towards the orientations shown in FIGS. 2 and 6. As illustrated in FIG. 14, the web halves 160 and 161 are now stretched along the shank of the pin 108, placing the edges 158 and 159 in positions to help hold the fingers 134 and 136 in their spread positions. These figures illustrate how the inclinations of the walls maximize the lateral pivotal extension of the fingers 134 and 136. The barbs 150 and 152 grip the rear surface of wall 22 as shown in those FIGS.

With the anchor assembly 66 installed on the wall 22 the rear face 88 of the foot 64 rests flush against the front surface 48 of the wall 22, and the foot 46 of the lower truss leg 38 rests flush against the front surface 48 of the wall 22 without attachment thereto as seen in FIG. 2 to provide stability for the brace 20.

After two or more of the anchor assemblies 66 are installed on the wall 22, the shelf 24 can be set in place. This is done by moving the shelf 24 so that the rod 28 is slid into the opening of hook 68. Then, with the stop 96 in the open position shown in FIG. 8, and with the drive pin 108 installed such as shown in FIG. 6, the rod 26 is moved through the passageway 93 to rest against the rib 92.

Since the opening of passageway 93 is at least slightly less than the thickness of the rod 26, the hook 76 flexes and the rod 26 snaps into the bite of the hook 76 with the rod 26 also resting against rib 92. The rod 28 then rests within hook 68. The length of the hook tip 70 provides tolerance for variations in shelves 24.

Since the normal position of the stop 96 is upwardly projecting, it stands out of the way of interference with the introduction of the rod 26 into the hook 76. Thereafter, using manual pressure, such as by a thumb, the stop 96 can be pivoted toward the position shown in FIGS. 2 and 6. As the stop 96 approaches that position, the projection 106 will enter the recess 116 readily. As the recess side walls 120 narrow, the resistance increases, but the plastic yields and allows the flanges 110 and 112 to snap into the recess 122. This positively locks the stop 96 into the closed position shown in FIGS. 2 and 6. In this position, the stop 96 extends into the passageway 80 to block escape of the rod 26 therethrough and to thus lock the rod 26 within the hook 76. Additionally, the head 106 of the drive pin 108 is received within the recess 104 and is covered from view by the stop 96.

Should it be desired to remove the shelf 24 and to remove the brace 20 from the wall 22, the stop 96 can be pried away from the foot 64 by the thumb and index finger to free the projection 106 and its lateral flanges 110 and 112 from the recesses 122 and 116. The stop 96 can then be pivoted upwardly to the open position as shown in FIG. 8. Then the shelf 24 can be grasped and removed.

Figure 11:
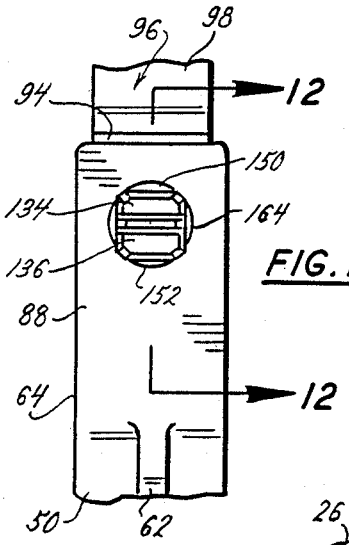
FIG. 11 is an end elevation taken on the line 11—11 of FIG. 8.
Figure 10:
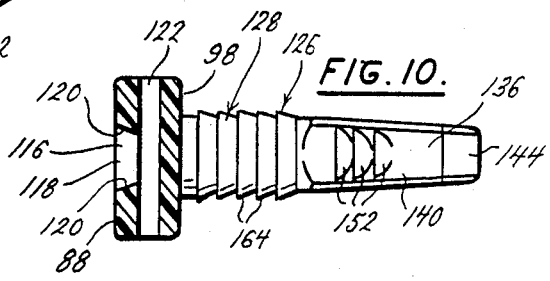
FIG. 10 is a section taken on the line 10—10 of FIG. 8.

Thereafter, the drive pin 108 can be rotated by a screwdriver in a direction to cause the threads 170 to withdraw the drive pin 108 from the socket 128. Once the drive pin 108 has cleared the walls 146 and 148 of the fingers 134 and 136, they can pivot back to the straight positions shown in FIGS. 7 and 11, and the socket 128 can be withdrawn from the hole in the wall 22.

There are various changes and modifications which may be made to applicant's invention as would be apparent to those skilled in the art. However, these changes or modifications are included in the teaching of applicant's disclosure, and it is intended that the invention be limited only by the scope of the claims appended hereto.

What is claimed is:

1. A molded plastic support brace for supporting a shelf to a mounting surface, such as a shelf for shoes, said shelf having first and second transverse members, the brace comprising: a first leg having a first end and a second end and a second leg having a first end and a second end, means for joining the first end of the first leg to the first end of the second leg such that the legs are divergent from said joined ends and their respective second ends are spaced from one another to provide spaced stabilizing wall contact members, means for attaching the second end of the first leg to the mounting surface, means accessible after attachment of the brace to the mounting surface for engaging the first shelf transverse member to the brace to resist movement therefrom by normal forces applied to the shelf, comprising a first hook member integral with and adjacent the second end of the first leg; the hook member having an opening for receiving the first transverse member; means for engaging the second shelf transverse member to the brace comprising a second hook member integral with and adjacent the first end of the first leg and shaped to extend about the second transverse member; and a blocking member on the first leg movable to a position to block the first hook member from release of the first shelf transverse member, the blocking member comprising a locking structure integral with the first leg and movable from a first open position, the first transverse member being movable to pass through the opening of the first hook member, to a closed position wherein movement of the first transverse member from the brace is blocked, the second end of the first leg comprising a foot for mounting to the mounting surface, the locking structure being pivotally mounted by a thin flexible member to the foot of the first leg, the lock structure comprising a stop with the stop and the foot having means for interengaging to hold the stop in the closed position, the interengaging means comprising a projection extending from one of the stop or the foot, the projection extending outwardly into an enlarged section, the other of the stop or the foot having recess means for receiving the projection to hold the projection therein, the enlarged section of the projection being resilient and the recess means for receiving the projection comprising a first recess having a cross section which for at least a part thereof has a span therebetween which is less than the span of the enlarged section so that the first recess acts to compress the enlarged section, and further comprising a second recess sized to receive the enlarged section to allow expansion thereof within the second recess to hold the enlarged section therein against normal operating forces.

2. A support brace for supporting a shelf to a mounting surface wherein the shelf has first and second transverse members comprising a first leg and a second leg integral with one another, the first and second legs each having a first end and a second end, a first hook integral with the first end of the first leg for engaging the first shelf transverse member, a second hook integral with the second end of the first leg for engaging the second shelf transverse member, the first ends of the legs being adjacent one another and the second ends of the legs being spaced from one another, means defining surface contact faces on the second ends to dispose the first leg at a downward incline away from the mounting surface when the faces are pressed against the mounting surface, and means to mount the support brace to the mounting surface, with the faces pressed against the mounting surface, the mounting means comprising a socket integral with the first leg and extending from the face of the first leg, a pair of fingers pivotally joined to the socket, a passage through the second end of the first leg and the socket, a pin extendable through the passage, the fingers having walls in the passage engageable by the pin to pivot the fingers to laterally extending positions, and a web in the passage between the face of the first leg and the walls of the fingers and being spaced from the walls of the fingers, the web being integral with the socket.

3. The support brace of claim 2 including a slit in the web, the web extending generally across the passage and being joined to a circumference of the passage.

4. The support brace of claim 2 wherein the walls of the fingers are inclined inwardly and toward the trailing end.

5. The support brace of claim 4 wherein the angle of inclination is between about 55 degrees and about 65 degrees to the axis of the passage.

6. The support brace of claim 4 wherein the web has portions generally parallel to the walls of the fingers.

7. A support brace for supporting a shelf to a mounting surface wherein the shelf has first and second transverse members comprising a first leg and a second leg integral with one another, the first and second legs each having a first end and a second end, a first hook integral with the first end of the first leg for engaging the first shelf transverse member, a second hook integral with the second end of the first leg for engaging the second shelf transverse member, the first ends of the legs being adjacent one another and the second ends of the legs being spaced from one another, means defining surface contact faces on the second ends to disposed the first leg at a downward incline away from the mounting surface when the faces are pressed against the mounting surface, and means to mount the support brace to the mounting surface, with the faces pressed against the mounting surface, the mounting means comprising a socket integral with the first leg and extending from the face of the first leg, a pair of fingers pivotally joined to the socket, a passage through the second end of the first leg and the socket, a pin extendable through the passage, the fingers having walls in the passage engageable by the pin to pivot the fingers to laterally extending positions, and the pin having a leading end and a trailing end, a point on the leading end, a plurality of longitudinal ribs projecting from the socket into the passage to grip the pin, a generally cylindical shank portion adjacent the point and terminating intermediate the leading end and the trailing end and being longer than the ribs, and helical threads between the cylindrical shank portion and the trailing end, the maximum diameter of the threads being greater than the diameter of the passage.

8. The support brace of claim 7 wherein the threads are defined by leading surfaces at less than 45° to the axis of the pin and trailing surfaces at greater than 45° to the axis of the pin, a head on the trailing end of the pin to facilitate driving the pin with a hammer, and a kerf in the head to receive a screwdriver.

9. The support brace of claim 8 wherein the trailing surfaces are at about 90° to the axis of the pin.

* * * * *